United States Patent [19]

Yoshida et al.

[11] Patent Number: 4,669,706

[45] Date of Patent: Jun. 2, 1987

[54] METHOD OF OPERATION OF EXHAUST-GAS TREATMENT SYSTEM OF SEALED-TYPE CONVERTER UNDER ABNORMAL CONDITIONS

[75] Inventors: Toru Yoshida, Sakai; Toyo-o Murata, Kitakyushu; Noriaki Suga, Tokyo, all of Japan

[73] Assignees: Nippon Steel Corporation, Tokyo; Kawasaki Jukogyo Kabushiki Kaisha, Hyogo, both of Japan

[21] Appl. No.: 821,920

[22] Filed: Jan. 21, 1986

[30] Foreign Application Priority Data

Jul. 6, 1984 [JP] Japan ..... 59-140281

[51] Int. Cl.[4] ..... C21B 5/28

[52] U.S. Cl. ..... 266/44; 266/81; 266/158; 75/59.18

[58] Field of Search ..... 266/158, 44, 81; 75/59.18

[56] References Cited

U.S. PATENT DOCUMENTS

| | | | |
|---|---|---|---|
| 3,220,826 | 11/1965 | Okaniwa et al. | 75/59.18 |
| 3,908,969 | 9/1975 | Baum et al. | 266/158 |
| 4,040,608 | 8/1977 | Vicard | 266/158 |
| 4,314,694 | 2/1982 | Veda et al. | 266/158 |
| 4,415,142 | 11/1983 | Hegemann et al. | 266/158 |

*Primary Examiner*—Melvyn J. Andrews

*Attorney, Agent, or Firm*—Wenderoth, Lind & Ponack

[57] ABSTRACT

The exhaust-gas treatment system of a sealed-type steel converter is operated at the time of an emergency during blowing by a method which comprises stopping the blowing of oxygen, opening an emergency air suction device connected to the hood while, at the same time, maintaining a converter controlling damper at its degree of opening at the time of stopping of the blowing, disconnecting the skirt of the hood from the converter mouth, and opening the damper to a specific degree of opening. By this simple method, sudden and great pressure drops within the converter are prevented, whereby CO gas of high purity can be efficiently recovered without the occurrence of damage to parts of the system due to abrupt pressure difference and explosion of CO gas.

5 Claims, 5 Drawing Figures

METHOD OF OPERATION OF EXHAUST-GAS TREATMENT SYSTEM OF SEALED-TYPE CONVERTER UNDER ABNORMAL CONDITIONS

BACKGROUND OF THE INVENTION

This invention relates generally to steel converters and exhaust-gas treatment systems thereof and more particularly to a method of operating such an exhaust-gas treatment system of a sealed-type converter for operating in a fully sealed state relative to the outside air or a state close thereto in the case wherein, during the blowing process step of the converter, an abnormal situation has arisen and the blowing process has been interrupted.

By the practice of the method of this invention, carbon monoxide, CO, gas of high purity can be efficiently recovered without any danger of explosion or damage to the parts of the exhaust-gas treatment system.

As is well known, the operation of a converter, in general, comprises the three process steps of charging, blowing, and pouring. In the blowing step, as will be described more fully hereinafter, the upstream end of the exhaust-gas treatment system is joined to the mouth of the converter by a hood and its skirt, which closes the gap therebetween. Then pure oxygen is blown through an oxygen lance into the converter and caused to react with the carbon in the molten metal therewith, thereby to accomplish refining.

Thus, a large quantity of CO gas is generated. This CO gas is drawn by an induced-draft fan into the hood and then through a cooler to be cooled, after which dust is removed from the gas, which is stored as a commercially valuable gas in a gas holder.

If this CO gas should leak out into the outside atmosphere, it would be extremely dangerous not only because it can cause carbon monoxide poisoning but also because it readily reacts with the outside air to cause a rapid combustion, and, if it is formed in the low-temperature region of CO gas, the combustion will become instantaneous, that is, an explosion will occur.

For this reason, in order to avoid leakage of CO gas to the outside, it is a common practice in converter operation to maintain the interior pressure within the converter at a negative (gauge) pressure by adjusting a damper for controlling the pressure within the converter. This damper is installed in the exhaust-gas treatment system, for example, between two dust removers. However, this measure causes outside air to be sucked into the hood through the gap between the converter mouth and the skirt, whereby the CO gas concentration is undesirably lowered. That is, the CO gas concentration is sacrificed for the sake of safety.

This infiltration of outside air into the hood in a conventional exhaust-gas treatment system is unavoidable in spite of the lowering of the skirt in the blowing step to close the gap between the converter mouth and the skirt. The reason for this is that, in actual practice, slag tends to accumulate on the rim of the converter mouth, which therefore does not always have a level smooth surface. Consequently, it becomes impossible to obtain an intimate leakproof state of sealing between the skirt and the converter mouth. This common type of converter exhaust-gas treatment system, which is herein referred to as the "semi-open type", is accompanied by the above described problem of lowering of the CO gas concentration.

However, because of a recent rise in the price of CO gas as a commercially valuable gas, there has arisen a need to recover CO gas of high purity as a by-product. In order to meet this need, exhaust-gas treatment systems of recent design have hoods and skirts which are so constructed as to afford a completely leakproof sealed state, or a state very close thereto, between the skirt and the converter mouth during the blowing process step. A system of this character in its operational state relative to the converter is herein referred to that of the "sealed type".

A sealed type converter and its exhaust-gas treatment system, however, is accompanied by the serious problem of explosion, even when it is provided with a special emergency air suction device, when it is operated according to a prior method, as will be described more fully hereinafter.

SUMMARY OF THE INVENTION

This invention seeks to solve the above and other problems by providing a method of operating an exhaust-gas treatment system of a sealed type converter, which method can be practiced with a high degree of safety and reliability, and in which the pressure within the converter and the system is prevented from dropping abruptly at the time of an abnormal or emergency situation during the blowing step of the converter. Moreover, this method in no way impairs the high productivity of a sealed type converter and its exhaust-gas treatment system in producing CO gas of high purity as a by-product.

According to this invention, briefly summarized, there is provided a method of operation as stated above which comprises stopping the blowing process, opening the emergency air suction device while, at the same time, maintaining the converter pressure controlling damper at the degree of opening thereof at the time of stopping of the blowing process, disconnecting the skirt from the converter mouth with the system in the resulting state, and opening the damper to a specific degree of opening.

The nature, utility, and further features of this invention will be more clearly apparent from the following detailed description when read in conjunction with the accompanying drawings, briefly described below.

DETAILED DESCRIPTION OF THE INVENTION

Figure 1:
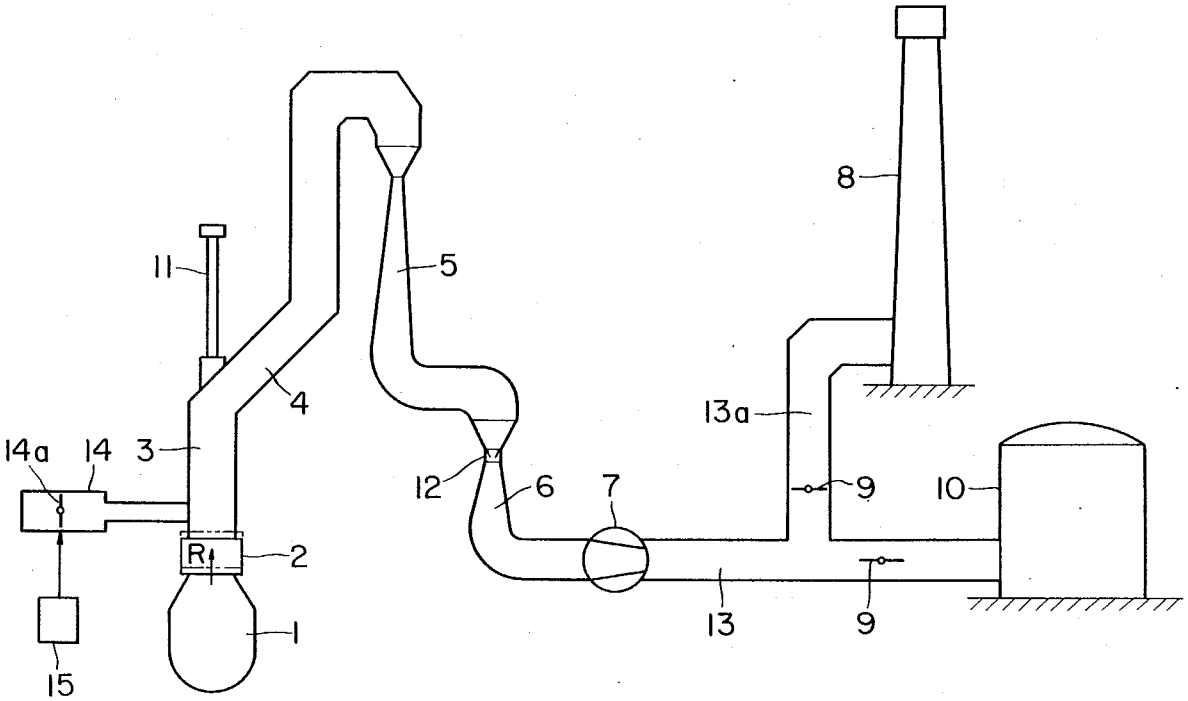
FIG. 1 is a schematic diagram showing a steel converter of sealed-type and the arrangement of essential components of an exhaust-gas treatment system of the converter.

An example of an exhaust-gas treatment system of a sealed-type converter to which the operational method of this invention is applicable will first be described with reference to FIG. 1. This system comprises, in sequentially serially connected state from its upstream end, a hood 3 having a skirt 2 connectable to and disconnectable from the mouth of a converter 1 and having an emergency air suction device 14, a cooler 4 for cooling CO gas, dust removers 5 and 6, a damper 12 interposed between the dust removers 5 and 6 for controlling the pressure within the converter 1, an induced-draft fan 7, a passage or duct 13, a branch duct 13*a*, a stack 8 connected at its bottom by way of the branch duct 13*a* to an intermediate part of the duct 13, and a gas holder 10 connected to the downstream end of the duct 13.

Dampers 9 are provided respectively in the upstream end of the branch duct 13*a* and in the duct 13 between its joint with the branch duct 13*a* and the gas holder 10. These dampers 9 are used to direct the flow of gas through the duct 13 selectively either to the stack 8 or to the gas holder 10. An oxygen lance 11 is inserted downward through the hood 3 and into the converter 1.

As was briefly described hereinbefore, the operation of a converter comprises essentially the three process steps of charging, blowing, and pouring. In the first or charging step, scrap steel is dumped into the converter 1 and molten pig iron produced in a shaft or blast furnace is charged by a hot-metal ladle from an upper level into the converter 1. In the second or blowing step, pure oxygen is blown into the molten metal thus charged into the converter 1 thereby to accomplish refining. In the third or pouring step, the molten steel thus refined is poured out of the converter into a teeming ladle at a lower level.

Of these three process steps, the charging step and the pouring step are carried out with the converter 1 in tilted states, and therefore, the skirt 2 of the hood 3 is raised during these steps to a position shown in chain lines and as indicted by arrow R in FIG. 1. In the second blowing step, the skirt 2 is lowered to close the gap between the mouth of the converter 1 and the skirt 2 thereby to prevent leakage of CO gas to the outside and infiltration of outside air.

In the event of an abnormal state or occurrence during the blowing step, a converter and its exhaust-gas treatment system of the aforementioned semi-open type is conventionally operated in the following manner.

In the case where the induced-draft fun 7 has stopped for some reason such as power failure, the blowing of oxygen into the molten metal in the converter 1 is stopped, and simultaneously the converter internal pressure control damper 12 is fully opened. The action of the induced-draft fan 7 which is then still rotating under its momentum is utilized to draw in outside air through the gap between the converter mouth and the skirt and thereby to cause combustion of the CO gas in the high-temperature region prior to cooling. A carbon dioxide, $CO_2$, gas layer is thus formed and functions to prevent direct contact between the cooled CO gas further downstream in the system and the outside air being drawn in, thereby precluding the danger of an explosion.

In a recent sealed-type exhaust-gas treatment system, however, the skirt 2 during the blowing step is in a tightly sealing state, or a state close thereto, relative to the converter mouth as described hereinbefore, whereby little or no air is drawn in therebetween. Consequently, an adequate $CO_2$ gas layer cannot be formed.

Accordingly, in a sealed-type exhaust-gas treatment system, a special emergency air suction device 14 is provided. A sealed-type system has heretofore been operated in the following manner at the time of an emergency.

Figure 2:
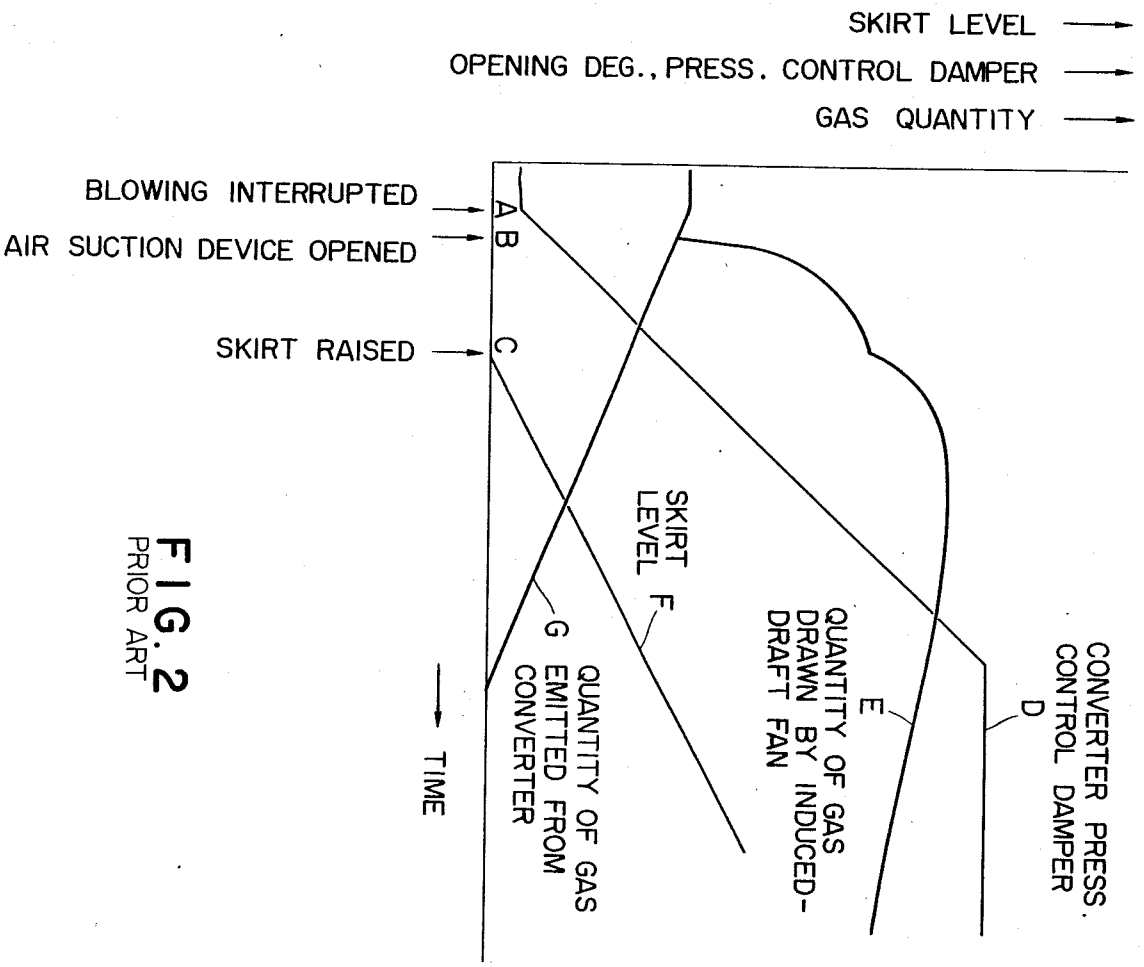
FIG. 2 PRIOR ART
FIG. 2 is graph indicating variations with time of essential conditions in the operation of an exhaust-gas treatment system at the time of abrupt blowing interruption according to a method of the prior art.

As indicated in FIG. 2, simultaneously with the occurrence of an emergency situation, the blowing operation is interrupted (point A), and at the same time the damper 12 for controlling the converter internal pressure is fully opened (curve D). Furthermore, the damper 14*a* (FIG. 1) of the emergency air suction device 14 is opened in response to a signal generated by a detection device (not shown) indicating the stoppage of blowing.

Figure 3:
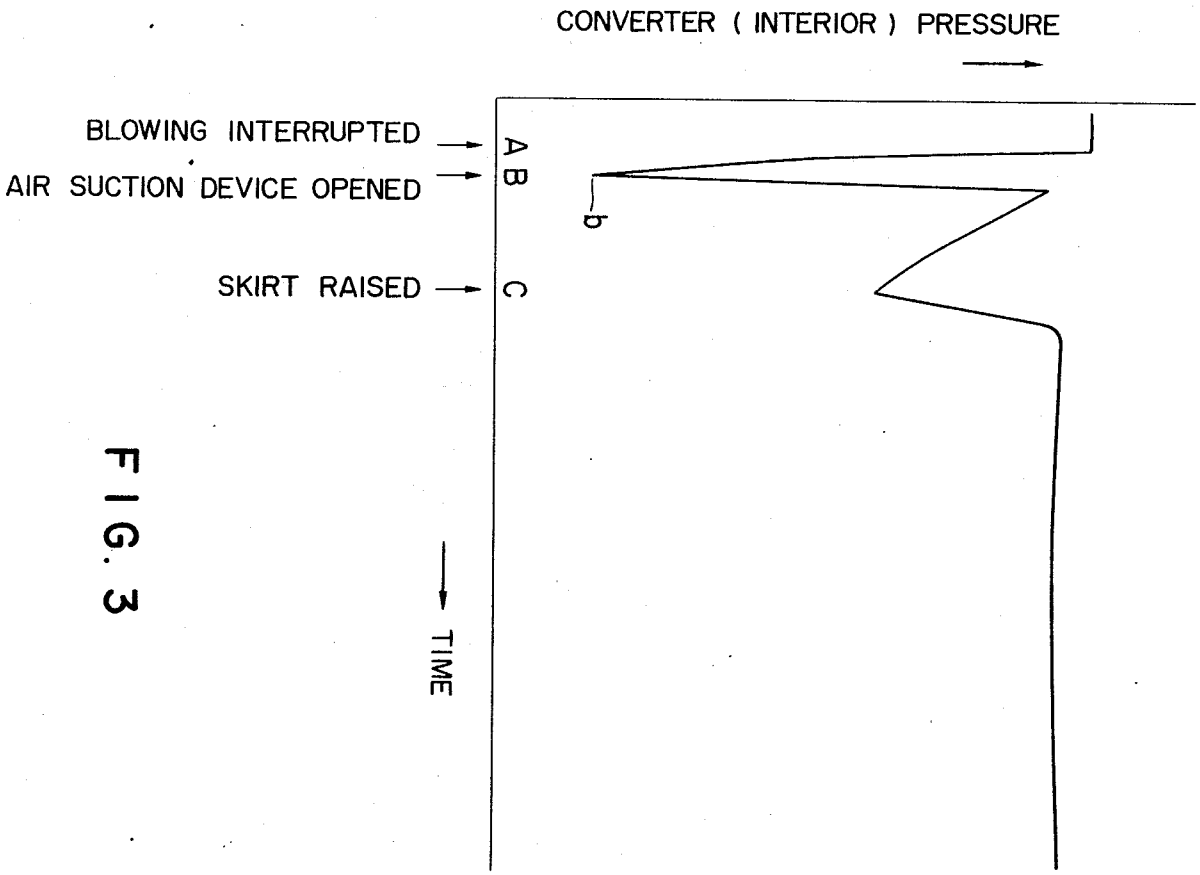
FIG. 3 is a graph indicating variations with time of the pressure within the converter resulting from the mode of operation indicated in FIG. 2.

However, a time delay A-B as indicated in FIG. 2 occurs from the instant the signal indicating blowing stoppage is received to the instant of full opening of the damper 14*a* of the emergency air suction device 14. As a consequence, the pressure within the converter drops instantaneously to a very low value as indicated at b in FIG. 3.

When the converter pressure drops instantaneously in this manner, outside air is apt to infiltrate into the exhaust-gas treatment system at unexpected parts thereof because it is not constructed to withstand great negative pressures. As a consequence, there is a great danger of an explosion. Furthermore, when the converter pressure drops abruptly, a great quantity of air enters instantaneously into the system through the emergency air suction device 14. If this air travels in unreacted state together with the CO gas within the system and thus reaches the low-temperature region, danger of explosion will arise.

Returning to FIG. 2, line F indicates the height or level of the skirt 2 by which the gap between the converter mouth and the skirt is determined, the skirt 2 being raised to draw in outside air. Line G indicates the quantity of gas generated in and emitted from the converter 1, while curve E indicates the quantity of gas drawn by the induced-draft fan 7.

The above described known operational method, wherein the converter pressure controlling damper 12 is fully opened at the same time as the interruption of blowing, and the damper 14*a* of the emergency air suction device 14 is opened in response to the signal indicative of blowing interruption, is accompanied by the serious problem of danger of explosion.

As stated hereinbefore, this invention seeks to solve the above problem by providing a method with a high degree of safety of operating an exhaust-gas treatment system of a sealed-type converter, in which method the pressure within the converter and the system is prevented from dropping abruptly.

More specifically, this invention provides an operational method characterized in that, instead of fully opening the converter pressure controlling damper 12 simultaneously with the interruption of blowing, as is done in the above described known method, the damper 14*a* of the emergency air suction device 14 is opened simultaneously with the interruption of blowing, while the degree of opening of the converter pressure controlling damper 12 is maintained at that opening at the time of interruption of blowing, and then, with these dampers in this state, the skirt 2 is raised, after which the converter pressure controlling damper 12 is opened to a specific degree of opening.

In order to indicate more fully the nature and utility of this invention, the following specific example of practice is set forth, it being understood that this example is presented as illustrative only and is not intended to limit the scope of the invention.

Figure 4:
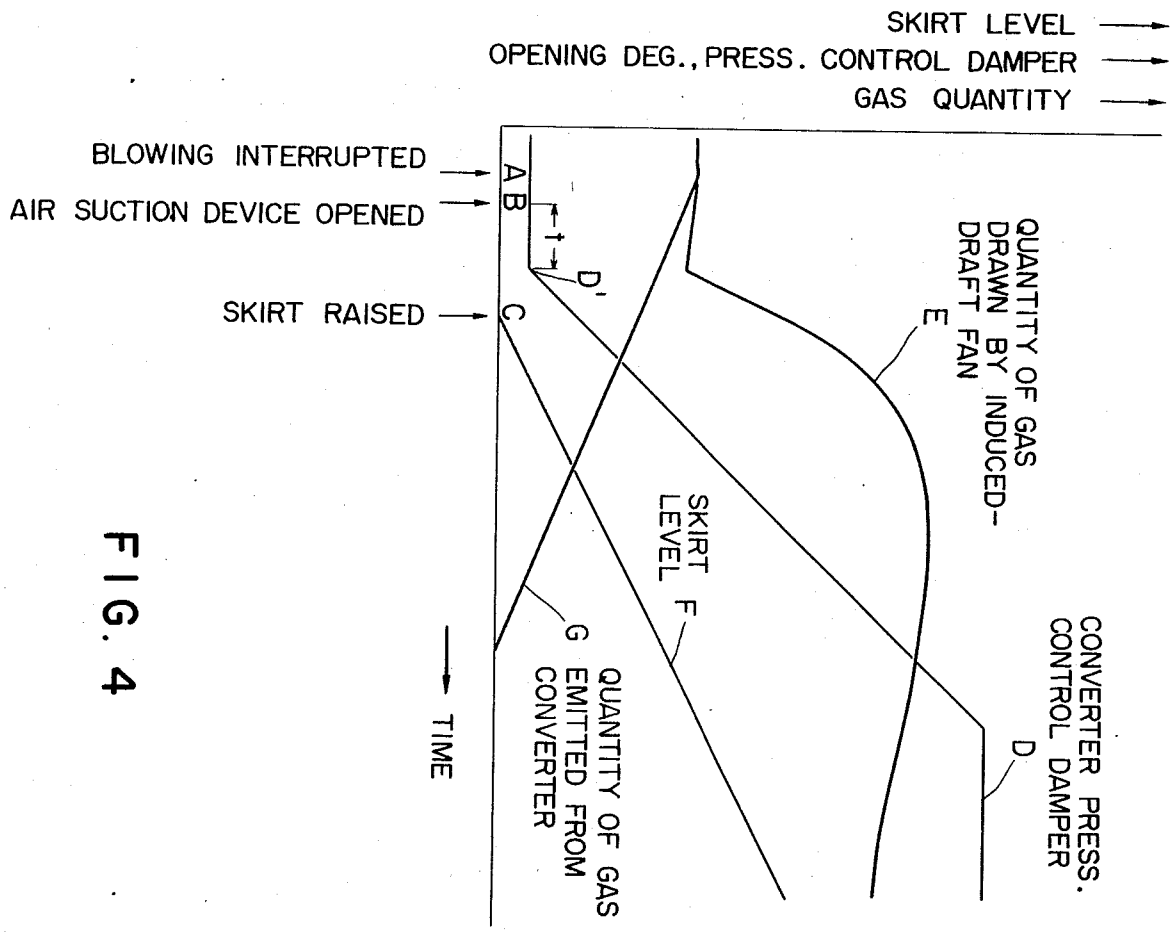
FIGS. 4 and 5 are graphs which correspond to FIGS. 2 and 3 but indicate the method of operation according to this invention of an exhaust-gas treatment system of a sealed-type converter.

In the method of this invention, the emergency air suction device 14 is connected to the hood 3 at a position as close as possible to the mouth of the converter 1. Referring to FIGS. 1 and 4, when an emergency situation arises during the blowing step of the converter 1, the blowing is interrupted (point A in FIG. 4). At this time, the converter pressure controlling damper 12 is maintained at its degree of opening at the time of blowing interruption. The quantity of gas being drawn by the induced-draft fan 7 at this time is that quantity at the time of blowing interruption, as indicated by curve E. A detection signal indicating the blowing interruption is transmitted by the detector 15 (FIG. 1) and is received by the emergency air suction device 14, which thereupon operates in response thereto, fully opening its damper 14*a* at time instant B after a specific time delay from the instant of blowing interruption (point A).

At this point in time, the converter pressure controlling damper 12 is being held at its degree of opening at that time. For this reason, the sum of the quantity of outside air sucks in through the emergency air suction device 14 and the quantity (line G) of CO gas generated from the converter as a consequence of blowing interruption is a quantity corresponding matchingly to the degree of opening of the converter pressure controlling damper 12. Accordingly, a reduction of the CO gas thus generated from the converter and an increase of the outside air thus sucked in balance, whereby no infiltration of outside air into the converter occurs, and there is no sudden change in the pressure within the converter, which pressure is maintained as it is.

Then, after a certain time t (after a few seconds, as at point D'), the converter pressure controlling damper 12 is operated to open toward the fully open state (line D), and, moreover, the skirt 2 begins to be raised (along the line F) somewhat later than the start of the opening of the damper 12. Then, as the sum of the outside air drawn in through the converter mouth and the skirt 2 and the outside air sucked in through the emergency air suction device 14, air corresponding to the degree of opening of the converter pressure controlling damper 12 is drawn into the converter 1.

The outside air thus entering the converter 1 reacts with the CO gas (line G) generated from the converter 1 at the time of blowing interruption and thus forms $CO_2$ gas. This $CO_2$ gas forms a partitioning layer which blocks direct contact between the CO gas previously cooled and existing within the exhaust-gas treatment system at a part further downstream and outside air drawn later into the system.

Figure 5:
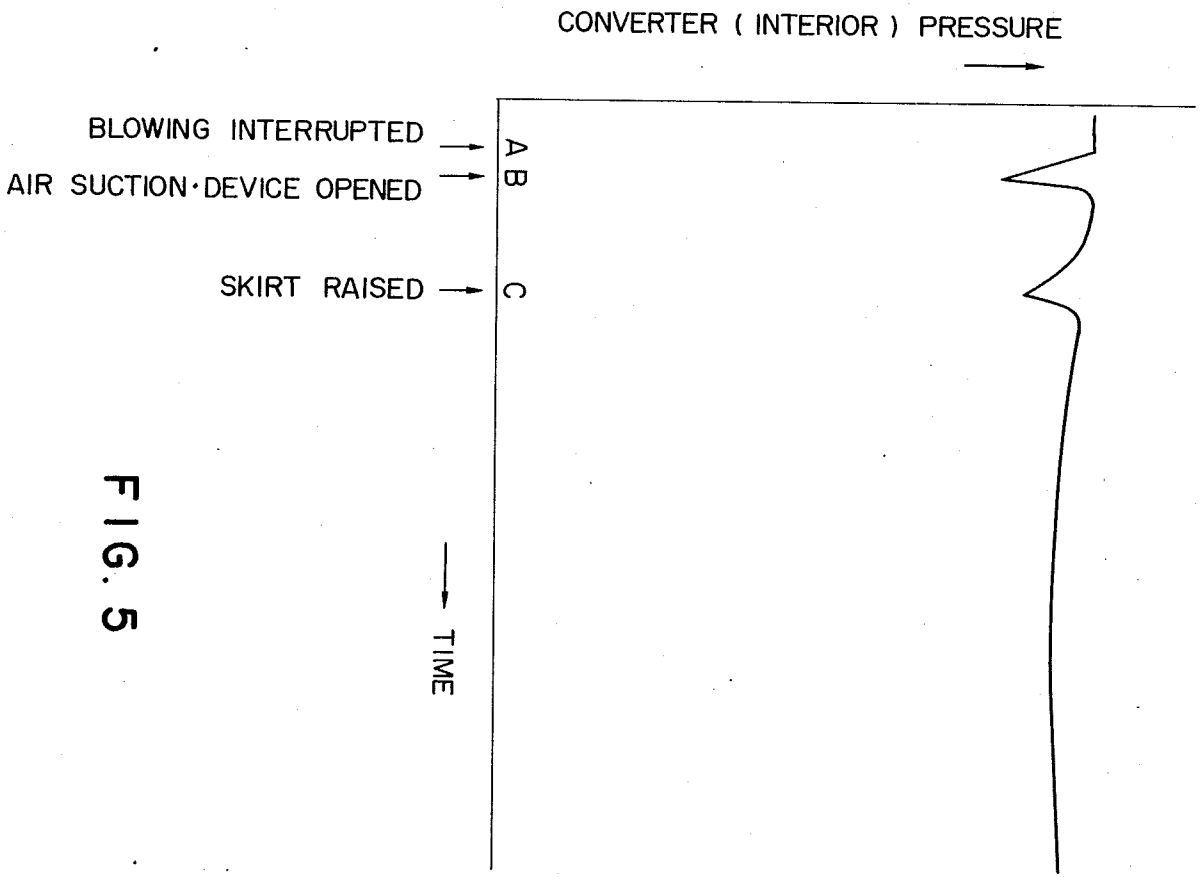

One example of the variation with time of the pressure within the converter in the case where the above described operation method is practiced is indicated in FIG. 5. Simultaneously with interruption of blowing, as at point A in FIG. 5, the converter pressure controlling damper 12 is held at its degree of opening at that instant. Receiving the detection signal indicating blowing interruption, the emergency air suction device 14 operates in response thereto to permit outside air to be sucked in (point B). In this case, a time lag AB occurs from the instant of blowing interruption (A) to the instant of start of operation of the suction device 14 to suck in outside air (point B). During this time lag or delay, suction is continued by the induced-draft fan 7, whereby the pressure within the converter drops instantaneously. Since the system is of sealed-type, this action occurs sensitively.

However, since the pressure controlling damper 12 is held at its degree of opening at that time, the drawing quantity of the induced-draft fan 7 is limited. The difference between this limit drawing quantity and the quantity of CO gas reduced by the blowing interruption is small, whereby the pressure within the converter 1 drops only somewhat. As a result, this pressure drop at this time is very slight.

Then, after a certain time (after a number of seconds), the pressure controlling damper 12 is fully opened, and at the same time the skirt 2 is raised, and outside air is drawn in through the gap between the converter mouth and the skirt. In this case, the operation of the mechanism (not shown) for raising the skirt 2 does not necessarily coincide with the opening speed of the pressure controlling damper 12, and the resulting time lag therebetween causes a pressure fluctuation as indicated at point C. The pressure fluctuation in this case is very slight.

As described above, according to the method of this invention for operating the exhaust-gas treatment system of a sealed-type converter at the time of an abnormal or emergency situation during the blowing step, the blowing of oxygen into the converter is stopped, and the converter pressure controlling damper is held at its degree of opening at the time of blowing interruption, outside air being drawn into the hood through the emergency air suction device. As a result, the drawing action of the induced-draft fan is restrained, and the pressure within the converter does not drop abruptly even when the blowing is interrupted and the quantity of CO gas decreases.

Furthermore, after a certain period of time, the skirt is raised as the converter pressure controlling damper is opened fully, and a large quantity of outside air is drawn in between the converter mouth and the skirt, whereby a $CO_2$ gas layer of ample quantity can be formed to function as a safety barrier.

In this manner, sudden variation of the pressure within the converter can be prevented, and at the same time, a $CO_2$ gas layer of ample quantity can be formed. As a result: a large quantity of air does not infiltrate instantaneously through the emergency air suction device at the time of blowing interruption; all of the infiltrating air reacts with CO gas; unpredicted infiltration of outside air through other parts of the exhaust-gas treatment system is prevented; and danger of explosion in the system is eliminated by the formation of the above mentioned $CO_2$ gas layer of large quantity. Therefore, a method of operating an exhaust-gas treatment system, which method is characterized by a high degree of safety and reliability and affords high productivity in the recovery of CO gas of high purity, is provided by this invention.

What is claimed is:

1. A method of operation of an exhaust-gas treatment system of an oxygen blowing converter having a mouth, when an abnormal converter operating condition occurs which necessitates interruption of oxygen blowing, said system comprising a hood with a skirt which is normally sealingly connected to said mouth of said converter and is disconnectable therefrom to form a gap between said skirt and said mouth, an emergency air suction device connected to said hood and having a damper adapted to be opened to allow flow of outside air therethrough into said hood, a converter pressure controlling damper downstream from said hood, and an induced draft fan downstream from said converter pressure controlling damper, said method comprising the steps of:

interrupting said oxygen blowing in response to occurrence of said abnormal converter operating condition;

opening said damper of said emergency air suction device in cooperation with said interruption of said oxygen blowing while, at the same time, maintaining said converter pressure controlling damper at the degree of opening thereof at the time of said interruption of said oxygen blowing, thereby to avoid sudden change in pressure within said converter;

disconnecting said skirt from said mouth of said converter to form a gap between said skirt and said mouth with said system in the resulting state, thereby to allow outside air to be drawn in through said gap; and opening said converter pressure controlling damper to a specific degree of opening.

2. A method according to claim 1 wherein said converter pressure controlling damper is operated to start its opening before said skirt begins to be disconnected from said mouth of said converter.

3. A method according to claim 1 wherein said converter pressure controlling damper is operated to start its opening a few seconds after the opening of said damper of said emergency air suction device.

4. A method according to claim 1 wherein the opening of said damper of said emergency air suction device is carried out in response to a signal from a detector for detecting said interruption of said oxygen blowing.

5. A method according to claim 1 wherein said specific dosage of opening is a degree corresponding to full opening.

* * * * *